US005508150A

United States Patent [19]

Craver et al.

[11] Patent Number: 5,508,150

[45] Date of Patent: Apr. 16, 1996

[54] FIXER ADDITIVES USED IN COMBINATION WITH IRON COMPLEX BASED BLEACHES TO PREVENT IRON RETENTION

[75] Inventors: Mary E. Craver, Rochester; Janet M. Huston, Webster; Robert J. Opitz, Rochester, all of N.Y.

[73] Assignee: Eastman Kodak Company, Rochester, N.Y.

[21] Appl. No.: 174,996

[22] Filed: Dec. 29, 1993

[51] Int. Cl.[6] ..... G03C 7/00; G03C 11/00; G03C 5/44

[52] U.S. Cl. ..... 430/393; 430/372; 430/428; 430/429; 430/430; 430/463

[58] Field of Search ..... 430/372, 393, 430/428, 429, 430, 455, 461, 463, 491, 492

[56] References Cited

U.S. PATENT DOCUMENTS

| | | | |
|---|---|---|---|
| 2,168,181 | 8/1939 | Ulrich et al. | 430/461 |
| 2,735,774 | 2/1956 | Henn | 95/88 |
| 3,352,676 | 11/1967 | Morcher et al. | 430/372 |
| 3,716,362 | 2/1973 | Meier | 96/60 R |
| 3,994,729 | 11/1976 | Shibaoka | 96/61 R |
| 3,997,348 | 12/1976 | Shimamura et al. | 430/372 |
| 4,444,873 | 4/1984 | Ishikawa et al. | 430/393 |
| 4,778,746 | 10/1988 | Ishikawa et al. | 430/372 |
| 4,778,748 | 10/1988 | Kuse et al. | 430/428 |
| 4,804,617 | 2/1989 | Nishikawa et al. | 430/393 |
| 4,963,474 | 10/1990 | Fujita et al. | 430/393 |
| 5,149,618 | 9/1992 | Tappe et al. | 430/461 |
| 5,183,727 | 2/1993 | Schmintou et al. | 430/372 |
| 5,238,791 | 8/1993 | Tappe et al. | 430/461 |
| B1 4,537,856 | 8/1985 | Kurematsu et al. | 430/372 |

FOREIGN PATENT DOCUMENTS

| | | | |
|---|---|---|---|
| 0486909 | 5/1992 | European Pat. Off. | 430/455 |
| 2361668 | 6/1974 | Germany | 430/393 |
| 2405819 | 8/1975 | Germany . | |
| 4226372 | 2/1994 | Germany . | |
| 52-137335 | 11/1977 | Japan . | |
| 56-019048 | 2/1981 | Japan . | |
| 60-239751 | 11/1985 | Japan . | |
| 61-118751 | 6/1986 | Japan . | |
| 61-277952 | 12/1986 | Japan | 430/372 |
| 63-046461 | 2/1988 | Japan . | |
| 57-200040 | 6/1988 | Japan . | |
| 63-284546 | 11/1988 | Japan | 430/455 |
| 1223457 | 9/1989 | Japan . | |
| 2190854 | 7/1990 | Japan . | |
| 2176744 | 7/1990 | Japan . | |
| 3101728 | 4/1991 | Japan . | |
| 3196140 | 8/1991 | Japan . | |

*Primary Examiner*—Charles L. Bowers, Jr.
*Assistant Examiner*—J. Pasterczyk
*Attorney, Agent, or Firm*—Sarah Meeks Roberts; J. Lanny Tucker

[57] ABSTRACT

A method of processing an image wise exposed and developed silver halide photographic element comprising bleaching the photographic element in a bleaching or bleach-fixing solution containing as the primary bleaching agent a complex of ferric ion and a tridentate or a tetradentate ligand, and then processing the photographic element in a solution containing a chelating compound represented by Formula I $$HOOC(CH_2)_m(X)\ ((CH_2)_nCOOH)_2 \quad (I)$$

where

X is N, or C—OH;

n and m are independently 0, 1, or 2; and

M is a cationic ion.

18 Claims, No Drawings

FIXER ADDITIVES USED IN COMBINATION WITH IRON COMPLEX BASED BLEACHES TO PREVENT IRON RETENTION

BACKGROUND OF THE INVENTION

This invention relates to the processing of silver halide photographic elements, and more specifically to the desilvering of such elements.

During processing of color silver halide elements the silver is oxidized to a silver salt by a bleaching agent, most commonly an iron-complex salt of an aminopolycarboxylic acid, such as the ferric ammonium complex salt of ethylenediaminetetraacetic acid. The bleaching step is followed by removal of this silver salt and any unused silver halide by a fixing agent, such as thiosulfate, which renders the silver salts and silver halide soluble.

The use of methyliminodiacetic acid, described in U.S. Pat. No. 4,294,914 by John Fyson and further described in patent application Ser. No. 08/125,491, by Foster, et al., now U.S. Pat. No. 5,334,491 provides a bleaching solution that accomplishes bleaching at lower molar levels of iron than current biodegradable bleaches and in combination with non-ammonium salts. These features enhance the environmental friendliness of the solution.

But bleaches prepared with tridentate or tetradentate ligands, such as methyliminodiacetic acid, nitriolotriacetic acid, iminodiacetic acid, and β-alaninediacetic acid, among others, do not form as stable of a complex with iron as do hexadentate ligands such as ethylenediaminetetraacetic acid and 1,3-propylenediaminetetraacetic acid, especially in the higher pH wash and/or fixing solutions that follow the bleaching step. These less stable iron complexes, when carried over into a fixer and/or wash, cause an increase in the D-min of the photographic element (especially yellow) due to iron retained in the emulsion. This problem is exacerbated when non-ammonium salts are used in the fixing solution.

Reduction in iron retention can be accomplished to a certain degree by adding a large molar excess of iron ligand to the bleach, which eventually gets 'carried over' into the following solutions. This method, however, requires much more of the chelant in the bleach solution and causes losses in bleaching efficiency. It also adds to the effluent load.

U.S. Pat. No. 4,444,873 describes using polycarboxylic acids in a fix to prevent staining in photographic elements which have been processed with a low pH bleach containing a ferric salt, organic acid and halide. It does not address the problem of staining caused by the stronger complexing ferric aminopolycarboxylic acid complexes.

U.S. Pat. No. 4,537,856 describes using water soluble chelates of certain metals in a stabilizer to reduce staining in photographic elements which have been desilvered and stabilized with no washing step. Such metal chelates, however, are not biodegradable.

Therefore, what is needed is a processing solution which, when utilized with a bleaching solution containing a bleaching agent which is a complex of ferric ion and a tridentate or tetradentate ligand, will prevent the formation of iron stains in the photographic element and will be environmentally friendly.

SUMMARY OF THE INVENTION

This invention provides a method of processing an imagewise exposed and developed silver halide photographic element comprising bleaching the photographic element in a bleaching or bleach-fixing solution having a pH greater than 3.0 and containing as the primary bleaching agent a complex of ferric ion and a tridentate or a tetradentate ligand and then processing the photographic element in a solution containing a chelating compound represented by Formula I $$MOOC(CH_2)_m(X)((CH_2)_nCOOM)_2 \quad (I)$$

where

X is N, or C—OH;

n and m are independently 0, 1, or 2; and

M is a cationic counterion.

The method of this invention prevents the iron staining of photographic emulsions that have been processed in a bleach containing as the primary bleaching agent a complex of ferric ion and a tridentate or a tetradentate ligand, thereby maintaining a good D-min. Further, the method of this invention provides for effective desilvering utilizing environmentally friendly processing solutions.

DETAILED DESCRIPTION

The chelating compounds of this invention are represented by Formula I.

$$MOOC(CH_2)_m(X)((CH_2)_nCOOM)_2 \quad (I)$$

where

X is N, or C—OH;

n and m are independently 0, 1, or 2; and

M is a cationic counterion.

The alkylene groups may be substituted or unsubstituted, providing the substituents are compatible with the photographic processing solution and do not complex with iron. M is preferably an H, or an alkali metal or ammonium ion. Particularly preferred are those chelating agents which are biodegradable. The preferred chelating compounds are citric acid, nitrilotriacetic acid, and β-alaninediacetic acid, and their salts, with the most preferred compound being citric acid.

It is surprising that the chelating agents of this invention are effective at reducing yellow stain. The tridentate and tetradentate ligands utilized in the bleaching solutions of this invention (such as methyliminodiactic acid) are relatively weak ligands compared to some others (such as ethylenediaminetetraacetic acid), which allows gelatin to compete for and complex with iron. It would not be surprising for a strong ligand (such as ethylenediaminetetraacetic acid) to break this gel-iron complex. It is most surprising 'that citrate, which the table below shows is a relatively weak ligand for iron, is able to interfere with the iron-gel complex. It is also unexpected that nitrilotriacetic acid and β-alaninediacetic acid, both of which are similar in complexation strength to methyliminodiacetic acid, are more effective than methyliminodiacetic acid at removing iron. It is also highly surprising that other polycarboxylic acids, such as iminodiacetic acid and tartartic acid, which have complexation strengths similar to or greater than citric acid, are not very effective at removing stains.

The following complexation constants are given for $Fe^{+2}$ and $Fe^{+3}$. Where there are two, they are given as 1st/2nd.

| | Complexation Constants With: | |
|---|---|---|
| Ligand | $Fe^{+2}$ | $Fe^{+3}$ |
| Ethylenediamine tetraacetic acid (EDTA) | 14.2 | 34 |
| 1,3-propylenediamine tetraacetic acid (PDTA) | 13.2 | 21.4 |
| β-alaninediacetic acid (ADA) | 8.45/11.4 | 16.1/21.6 |
| nitrilotriacetic acid (NTA) | 8.84 | 16.1/23.7 |

-continued

| Ligand | Complexation Constants With: $Fe^{+2}$ | $Fe^{+3}$ |
|---|---|---|
| methyliminodiacetic acid (MIDA) | 6.7/12.0 | 12.0/21.4 |
| Iminodiacetic acid (IDA) | 5.8/10.1 | 12.2/19.9 |
| tartaric acid | 4.85 | 18.1/15.3 |
| Succinic acid | | 7.5 |
| Malic acid | 2.5 | 7.1 |
| Citric acid | 4.4 | 11.4 |

The chelating compounds of this invention can be added to almost any solution (provided it is chemically compatible) following the bleach or bleach-fix solution. For example, they can be added to a washing solution, a fixing solution or a stabilizing solution. However, the removal of iron from the emulsion can most effectively be accomplished if the chelating agent is present in the solution immediately following the bleach or bleach-fix solution. If there is an intervening wash between the bleach and the solution containing the chelating agent, it may be necessary to use a greater amount of the chelating agent.

The chelating compounds are water soluble and may be added directly to the appropriate processing solution. The concentration of the additive must be sufficient to extract iron from the emulsion. The amount needed will vary with the iron concentration of the preceeding solution and the degree of seasoning of the solution containing the additive. Generally 0.005 mol to 1.0 mol of the chelating compound per liter of processing solution may be used, with 0.01 mol to 0.2 mol being preferred.

Examples of fixing agents which may be used in the this invention are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1,8-octane diol); or a thiourea. These fixing agents can be used singly or in combination. Thiosulfate is preferably used in the present invention. For environmental reasons, it is preferred that the fixing solution contains substantially no ammonium ion. That is, the only ammonium ion present is that which is carried in by the photographic element.

The concentration of the fixing agent per liter is preferably about 0.2 to 2 mol. The pH range of the fixing solution is preferably 3 to 10 and more preferably 5 to 9. In order to adjust the pH of the fixing solution an acid or a base may be added, such as hydrochloric acid, sulfuric acid, nitric acid, acetic acid, bicarbonate, ammonia, potassium hydroxide, sodium hydroxide, sodium carbonate or potassium carbonate.

The fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is about 0 to 0.50 mol/liter, and more preferably 0.02 to 0.40 mol/liter as an amount of sulfite ion. Ascorbic acid, a carbonyl bisulfite acid adduct, or a carbonyl compound may also be used as a preservative.

The bleaching agents of this invention are complexes of ferric ion and a tridentate or tetradentate ligand. The bleaching agent originates in a bleaching solution which is either a bleach bath or a bleach-fix bath. The preferred ligands in the bleaching solution are ionized aminopolycarboxylic acids, although other ligands which form ferric ion salt complexes having bleaching ability and which meet the complexation requirements of this invention may be used. Such ligands might include dipicolinic acid or ligands having $PO_3H_2$ groups. The tridentate aminopolycarboxylic acids which may be used are those which have only three binding sites to the ferric ion, that is they have no additional substituents which might bind to the ferric ion. Further, they must be water soluble, form ferric complexes which have bleaching ability and be compatible with silver halide bleaching systems. The tetradentate aminopolycarboxylic acids which may be used must meet the same criteria except they must contain only four binding sites. Preferably the aminopolycarboxylic acids are biodegradable.

More preferred is a tridentate ligand represented by Formula (II) or a tetradentate ligand represented by Formula (III) below:

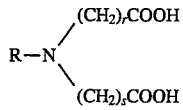

(II)

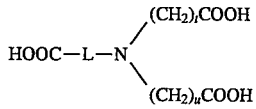

(III)

R represents H, or a substituted or unsubstituted alkyl group, aryl group, arylalkyl group or heterocyclic group. Preferably R is an alkyl group and more preferably it contains 1 to 3 carbon atoms. The letters r, s, t and u are independently 1, 2, or 3. More preferably r and s are 1, and t and u are independently 1 or 2. The substituents on R can be any group which does not bind to ferric ion, examples of which are

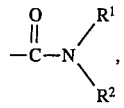

$—OR^3$, $—SR^4$, where $R^1$ through $R^4$ represent an alkyl group or hydrogen atom. The linking group, L, may be any group which does not bind ferric ion and which does not cause the compound to be water insoluble. Preferably, L is a substituted or unsubstituted alkylene group, arylene group, arylalkylene group or heterocyclic group and, more preferably, L is an alkylene chain of one to three carbon atoms which may also be substituted with other non-complexing groups such as a methyl or aryl group.

Representative examples of tridentate ligands which can be described by Formula (II) are listed below, but the compounds are not limited by these examples. The most preferred compound is methyliminodiacetic acid, compound 2.

List I

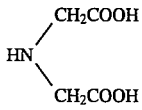

1.

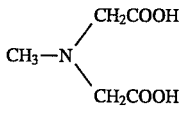

2.

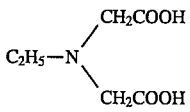

3.

-continued

List I

4. 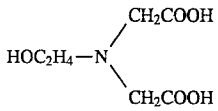

5. 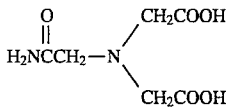

6. 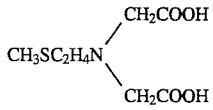

7. 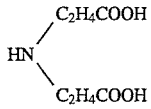

8. 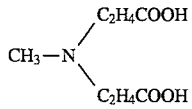

9. 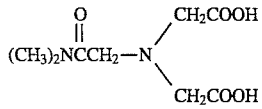

Representative examples of tetradentate compounds which can be described by Formula (III) are listed below but the compounds are not limited by these examples. The most preferred compounds are nitrilotriacetic acid, compound 1 and β-alaninediacetic acid, compound 2.

List II

1. 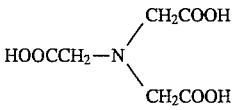

2. 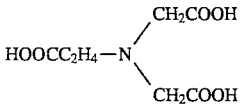

3. 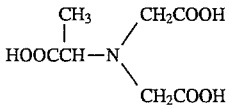

4. 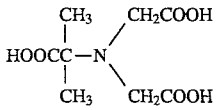

5. 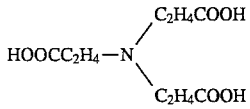

6. 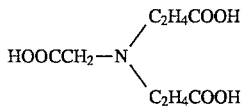

Many of the tridentate and tetradentate ligands of this invention are commercially available or can be prepared by methods known to those skilled in the art.

These aminopolycarboxylic acid ferric complexes are used in the form of a sodium salt, potassium salt, or ammonium salt. An ammonium salt may be preferred for speed, with alkali salts being preferred for environmental reasons.

The content of the salt of an aminopolycarboxylic acid ferric complex in the bleaching solutions of this invention is about 0.05 to 1 mol/liter. The pH range of the bleaching solution is 3 to 7, and preferably 4 to 7.

The bleaching solution can contain rehalogenating agents such as bromides (e.g., potassium bromide, sodium bromide, and ammonium bromide), chlorides (e.g., potassium chloride, sodium chloride, and ammonium chloride), and iodides (e.g., ammonium iodide). They may also contain one or more inorganic and organic acids or alkali metal or ammonium salts thereof, and have a pH buffer such as boric acid, borax, sodium metaborate, acetic acid, sodium acetate, sodium carbonate, potassium carbonate, phosphorous acid, phosphoric acid, sodium phosphate, succinic acid, citric acid, sodium citrate, and tartaric acid, or corrosion inhibitors such as ammonium nitrate and guanidine. The bleaching solution may also contain bleach accelerators, brighteners or other additives.

The photographic elements of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. The element may also contain a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of the invention can include various couplers including, but not limited to, those described in Research Disclosure Section VII, paragraphs D, E, F, and G and the publications cited therein. These couplers can be incorporated in the elements and emulsions as described in Research Disclosure Section VII, paragraph C and the publications cited therein.

The photographic elements of this invention or individual layers thereof can contain among other things brighteners (examples in Research Disclosure Section V), antifoggants and stabilizers (examples in Research Disclosure Section VI), antistain agents and image dye stabilizers (examples in Research Disclosure Section VII, paragraphs I and J), light absorbing and scattering materials (examples in Research Disclosure Section VIII), hardeners (examples in Research Disclosure Section X), plasticizers and lubricants (examples in Research Disclosure Section XII), antistatic agents (examples in Research Disclosure Section XIII), matting agents (examples in Research Disclosure Section XVI) and development modifiers (examples in Research Disclosure Section XXI).

The photographic elements can be coated on a variety of supports including, but not limited to, those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image, examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

The color developing solutions typically contain a primary aromatic amino color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amino color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamine monohydrochloride, 4-N,N-diethyl-2-methylphenylenediamine monohydrochloride, 4-(N-ethyl-N-2-methanesulfonylaminoethyl)-2methylphenylenediamine sesquisulfate monohydrate, and 4-(N-ethyl-N-2-hydroxyethyl)-2-methylphenylenediamine sulfate.

In addition to the primary aromatic amino color developing agent, color developing solutions typically contain a variety of other agents such as alkalies to control pH, bromides, iodides, benzyl alcohol, anti-oxidants, anti-foggants, solubilizing agents, brightening agents, and so forth.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing, or bleach-fixing to remove silver and silver halide, washing and drying. Additional bleaching, fixing and bleach-fixing steps may be utilized.

Typically, a separate pH lowering solution, referred to as a stop bath, is employed to terminate development prior to bleaching. A stabilizer bath is commonly employed for final washing and hardening of the bleached and fixed photographic element prior to drying. A bath can be employed prior to color development, such as a prehardening bath, or the washing step may follow the stabilizing step. Additionally, reversal processes which have the additional steps of black and white development, chemical fogging bath, light re-exposure, and washing before the color development are contemplated. In reversal processing there is often a bath which precedes the bleach which may serve many functions, such as an accelerating bath, a clearing bath or a stabilizing bath. Conventional techniques for processing are illustrated by Research Disclosure, Paragraph XIX.

The following examples are intended to illustrate, without limiting, this invention.

EXAMPLES

Example 1

Sixteen strips of a standard high chloride 35 mm paper were processed in a small processing machine. The following processing solutions and processing times were used with the variations indicated in Table I. The developer utilized was a standard color paper developer.

| | |
|---|---|
| Developer | 45 sec. |
| Stop Bath | 22 sec. |
| Bleach | 30 sec. |
| First Wash | 30 sec. |
| Fix | 45 sec. |
| Final Wash | 90 sec. |
| Stop Bath | |
| 7% Acetic acid and water | |
| Bleach formulas: | |
| Ferric MIDA Bleach | |
| $Fe(NO)_3.9H_2O$ | 108.5 g/L |
| MIDA | 86.8 g/L |
| $NH_4Br$ | 25.0 g/L |
| $CH_3COOH$ | 25.0 mLs/L |
| Water to 1 liter | |
| pH 4.50 | |
| Ferric PDTA Bleach | |
| Acetic Acid | 5.63 mLs/L |
| KBr | 23.93 g/L |
| PDTA | 15.35 g/L |
| diethylenetriamine pentaacetic acid (DPTA) | 0.50 g/L |
| KOH (45%) | 21.17 mL/L |
| $Fe(NO)_3.9H_2O$ | 18.33 g/L |
| Water to 1 liter | |
| pH 5.00 | |

-continued

| | |
|---|---|
| Wash formulas: | |
| Citric Wash | |
| Citric acid | 1.0 g/L |
| Water | 1 L |
| pH 2.75 | |
| Standard Wash | |
| Water | |
| Fixer formulas: | |
| Citric Acid Fixer | |
| $K_2SO_3$ (45%) | 35.6 ml/L |
| Citric Acid | 1.0 g/L |
| $Na_2S_2O_3.5H_2O$ | 42.7 g/L |
| Acetic acid | 9.6 mL/L |
| KOH (45%) | 16.6 mL/L |
| Water to 1 liter | |
| pH 7.5 | |
| Standard | |
| $K_2SO_3$ (45%) | 35.6 ml/L |
| EDTA | 1.0 g/L |
| $Na_2S_2O_3.5H_2O$ | 42.7 g/L |
| Acetic acid | 9.6 g/L |
| KOH (45%) | 16.6 mL/L |
| Water to 1 liter | |
| pH 7.5 | |
| Final Wash formulas: | |
| Citric Wash | |
| Citric acid | 1.0 g/L |
| Water | 1 L |
| Standard Wash | |
| Water | |

The D-min and D-max of the processed strips were read with a reflection densitometer. The blue D-min shown in Table I below is a measure of the amount of iron retained in the paper emulsions after processing through various fixers and washes following a Ferric MIDA based bleach.

TABLE I

| | | Additive Placement | | | |
|---|---|---|---|---|---|
| | Bleach | First Wash | Fixer | Final Wash | Blue D-min |
| 1. | FePDTA | — | — | — | 0.109 |
| 2. | FeMIDA | citric | — | — | 0.131 |
| 3. | FeMIDA | citric | — | citric | 0.126 |
| 4. | FeMIDA | — | — | citric | 0.176 |
| 5. | FeMIDA | citric | citric | — | 0.121 |
| 6. | FeMIDA | citric | citric | citric | 0.125 |
| 7. | FeMIDA | — | citric | citric | 0.162 |
| 8. | FeMIDA control | — | — | — | 0.297 |
| 9. | FeMIDA | — | citric | — | 0.252 |

It is clear from the data that for Sample 8, in which none of processing solutions following the ferric MIDA bleach contained a chelating agent of this invention, the blue D-min is quite high. All of the samples processed utilizing citric acid in the processing solutions following a ferric MIDA bleach showed reduced blue D-min. The data further demonstrates that the most reduction is achieved when the chelating agent is contained in a processing solution immediately following the bleach.

Example 2

This example demonstrates the impact on retained iron of adding various concentrations of citric acid to the wash. Sixteen strips of a standard high chloride 35 mm paper were processed in a small processing machine. The following processing solutions and processing times were used with the variations indicated in Table II. The developer utilized was a standard color paper developer.

| | |
|---|---|
| Developer | 45 sec. |
| Stop Bath | 22 sec. |
| Bleach | 30 sec. |
| First Wash | 30 sec. |
| Fix | 45 sec. |
| Final Wash | 90 sec. |
| Stop Bath | |
| 7% Acetic acid and water | |
| Bleach formulas: | |
| Ferric MIDA Bleach | |
| $Fe(NO)_3.9H_2O$ | 108.5 g/L |
| MIDA | 86.8 g/L |
| $NH_4Br$ | 25.0 g/L |
| $CH_3COOH$ | 25.0 mLs/L |
| Water to 1 liter | |
| pH 4.50 | |
| Ferric PDTA Bleach | |
| Acetic Acid | 5.63 mLs/L |
| KBr | 23.93 g/L |
| PDTA | 15.35 g/L |
| DPTA | 0.50 g/L |
| KOH (45%) | 21.17 mL/L |
| $Fe(NO)_3.9H_2O$ | 18.33 g/L |
| Water to 1 liter | |
| pH 5.00 | |
| Wash formulas: | |
| Citric Wash | |
| Citric acid | See Table II |
| Water | 1 L |
| pH 2.75 | |
| Standard Wash | |
| Water | |
| Fixer | |
| $K_2SO_3$ (45%) | 35.6 ml/L |
| EDTA | 1.0 g/L |
| $Na_2S_2O_3.5H_2O$ | 42.7 g/L |
| Acetic acid | 9.6 g/L |
| KOH (45%) | 16.6 mL/L |
| Water to 1 liter | |
| pH 7.5 | |
| Final Wash | |
| Water | |

The D-min and D-max of the processed strips were read with a reflection densitometer. The blue D-min shown in Table II below is a measure of the amount of iron retained in the paper emulsions after processing through washes containing various levels of citric acid following a Ferric MIDA based bleach or a ferric PDTA based bleach.

TABLE II

| | | Citric Acid Wash After FePDTA Bleach | | | Citric Acid Wash After FeMIDA Bleach | | | |
|---|---|---|---|---|---|---|---|---|
| | | 0 moles | 0.005M | 0.05M | 0 moles | 0.005M | 0.02M | 0.05M |
| D-min | R | 0.099 | 0.098 | 0.098 | 0.112 | 0.099 | 0.098 | 0.097 |
| | G | 0.096 | 0.095 | 0.094 | 0.172 | 0.105 | 0.098 | 0.096 |
| | B | 0.116 | 0.115 | 0.115 | 0.354 | 0.138 | 0.120 | 0.117 |
| D-max | R | 2.604 | 2.585 | 2.584 | 2.619 | 2.611 | 2.606 | 2.595 |
| | G | 2.601 | 2.610 | 2.619 | 2.590 | 2.598 | 2.597 | 2.590 |
| | B | 2.459 | 2.498 | 2.495 | 2.546 | 2.489 | 2.481 | 2.461 |
| 0.4 SHL | R | 2.191 | 2.178 | 2.180 | 2.214 | 2.202 | 2.212 | 2.213 |
| | G | 2.137 | 2.115 | 2.107 | 2.087 | 2.096 | 2.102 | 2.105 |
| | B | 2.006 | 1.989 | 1.981 | 1.944 | 1.985 | 1.998 | 1.981 |

*The iron level is approximately 0.045M in the preceding bleach

The data shows that adding citric acid to the wash after using a ferric MIDA bleach greatly reduces the blue D-min. It is obvious from Table II that there is no problem with retained iron when the bleaching agent is a ferric complex of a hexadentate aminopolycarboxylic acid, and that adding citric acid to the wash has no effect. It also shows that the level of citric acid should preferably be greater than 0.01M for fully effective removal of iron stain, although lower levels do show some improvement.

Example 3

A bromoiodide color reversal film was processed in a rack-and-tank processor using a standard color reversal process, the KODAK Process E-6, as described in the British Journal of Photography Annal, P.191, (1988), except as indicated below for the bleaching and fixing solutions. Variations in the processing solutions are indicated in Table III.

'Seasoned' fixer formulations:

| | |
|---|---|
| $Na_2S_2O_4$ | 79 grams |
| Na metabisulfite | 11.2 grams |
| Fixer Additive | see Table III |
| Iodide | 75 mg |
| Ag (as AgBr) | approx 7.8 grams (4.5 g silver) |
| Fe | 0.45M |
| Bromide, and other bleach constituents | dependent on bleach formulation |
| Water to 1 L | |
| pH | 6.6 |

| Chemical | Amount |
|---|---|
| **Bleach #1 (Ferric MIDA)** | |
| water | 850 mLs |
| ferric MIDA complex | 174 grams |
| MIDA salt | 50 Grams |
| $KNO_3$ | 136 grams |
| acidic buffer | 31 mL |
| bromide salt | 4.25 grams |
| pH | 4.25 |
| Total Volume | 1 liter |
| **Bleach #2 (Ferric EDTA)** | |
| water | 800 mLs |
| ferric EDTA complex | 164 grams |
| EDTA salt | 13.5 Grams |
| $KNO_3$ | 31.3 grams |

-continued

| | |
|---|---|
| bromide salt | 135 grams |
| pH | 5.8 |
| Total Volume | 1 liter |

*Iron was usually added as a bleach formulation, as if it were 'carried over' from the previous process tank.

After processing the amount of retained iron in the film samples was measured by X-ray fluorescence and is shown as Fe level in counts/sec in Table III below.

TABLE III

| Bleach | Wash | Fixer Additive | Fixer Salts | Fe level counts/sec |
|---|---|---|---|---|
| # 1 | none | EDTA, 1 g/L* | $Na^+$ | 800 |
| # 1 | none | EDTA, 1 g/L | $NH_4^+$ | 320 |
| # 1 | none | citric acid, 10 g/L | $Na^+$ | 160 |
| # 1 | none | citric acid, 10 g/L | $NH_4^+$ | 140 |
| # 2 | none | EDTA, 1 g/L | $Na^+$ | 120 |
| # 2 | none | EDTA, 1 g/L | $NH_4^+$ | 120 |

*1 gram of EDTA is amount contained in standard Process E-6 fixer

The data shows that following a MIDA bleach citric acid is more effective at removing iron from an emulsion than the standard EDTA fixer. It is undesirable to increase the level of EDTA above 1 gram because it is not biodegradable.

Example 4

The following is a comparison of various chelating compounds and their effectiveness at removing iron from a gelatin coating. Samples of a standard color reversal film were processed as described in Example 3, using Bleach #1. The fixer additives (chelating compounds) utilized are shown in Table IV. After processing, the amount of retained iron in the film samples was measured by X-ray fluorescence and is shown as Fe level in mg/sqft in Table IV below. Also shown in Table IV are the chelating constants of the various fixer additives. Biodegradability was determined using the Modified Sturm Test (OECD Guideline 301B—EEC/Annex V Guideline C.5).

TABLE IV

| Chelating Compound (0.05M)* | Fe, mg/sq ft | Bio* | Part of Invention | Fe+2 | Fe+3 |
|---|---|---|---|---|---|
| none | 3.4, 2.9, 3.0 | — | — | | |
| citric acid | 0.8, 0.6 | Y | Y | 4.4 | 11.4 |
| DTPA | 0.5 | N | N | 16.6 | 27.3 |
| EDTA | 0.5 | N | N | 14.2 | 34 |
| +iron | 0.6 | N | N | | |
| 1-hydroxyethylidene 1,1-diphosphonic acid | 0.6 | N | N | 9.05 | 16.2/25.3 |
| NTA | 0.7 | Y | Y | 8.84 | 16.1/23.7 |
| 2-hydroxy-1,3-propylenediamine tetraacetic acid | 0.8 | N | N | 16.5 | >18 |
| ADA | 0.8 | Y | Y | 8.45/11.4 | 16.1/21.6 |
| aminotris(methylphosphonic acid), pentasodium salt | 0.9 | N | N | 11.0 | 24.0 |
| tartaric acid | 1.9 | Y | N | 4.85 | 18.1/15.3 |
| IDA | 2.4 | Y | N | 5.8/10.1 | 12.2/19.9 |
| MIDA | 2.4 | Y | N | 6.7/12.0 | 12.0/21.4 |
| malonic acid | 2.6 | Y | N | 2.8 | 15.7 |
| glycolic acid | 2.9 | Y | N | | 4.7 |
| succinic acid | 3.2 | Y | N | | 7.5 |
| glyceric acid | 3.3 | Y | N | | |
| malic acid | 3.5 | Y | N | 2.5 | 7.1 |

*Bio—Readily biodegradable

As can be seen by the data, many polycarboxylic acids are not effective at removing retained iron even though they have similiar complexation constants to the effective chelants. Further, it can be seen that the chelating compounds of this invention are biodegradable.

While the invention has been described in detail and with reference to specific embodiments thereof, it will be apparent to one skilled in the art that various changes and modifications can be made therein without departing from the spirit and scope thereof.

What is claimed is:

1. A method of processing an imagewise exposed and developed color silver halide photographic element comprising bleaching the photographic element in a bleaching or bleach-fixing solution having a pH greater than 3.0 and containing as the bleaching agent a complex of ferric ion and a tridentate or a tetradentate aminopolycarboxylic acid ligand and then processing the photographic element in a solution containing a biodegradable chelating compound represented by Formula I $$MOOC(CH_2)_m(X)((CH_2)_nCOOM)_2 \quad (I)$$

where

X is N, or C—OH;

n and m are independently 0, 1, or 2, and

M is a cationic counterion.

2. The method of claim 1 wherein the chelating compound is citric acid.

3. The method of claim 1 wherein the photographic element is processed in a processing solution containing the chelating compound immediately after bleaching.

4. The method of claim 1 wherein the bleaching agent is a ferric complex of a tridentate aminopolycarboxylic acid represented by Formula II

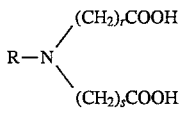

(II)

wherein

R is H or an alkyl group; and r and s are 1, 2, or 3.

5. The method of claim 1 wherein the bleaching agent is a ferric complex of a tetradentate aminopolycarboxylic acid represented by Formula III

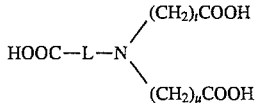

(III)

wherein t and u are 1, 2, or 3; and

L is a linking group.

6. The method of claim 4 wherein R is an H or an alkyl group of 1 to 3 carbon atoms and r and s are 1.

7. The method of claim 5 wherein L is an alkylene group of 1 to 3 carbon atoms and t and u are 1 or 2.

8. The method of claim 6 wherein the tridentate ligand is methyliminodiacetic acid.

9. The method of claim 1 wherein the aminopolycarboxylic acid is biodegradable.

10. The method of claim 1 wherein the processing solution containing the chelating compound is a fixing solution.

11. The method of claim 10 wherein the fixing solution contains substantially no ammonium ion.

12. The method of claim 1 wherein the chelating compound is citric acid; wherein the tridentate aminopolycarboxylic acid is represented by Formula II

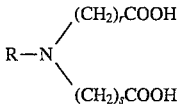

(II)

wherein

R is H or an alkyl group; and r and s are 1, 2, or 3; and the tetradentate aminopolycarboxylic acid is represented by Formula III

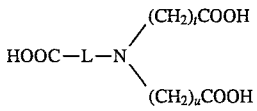

(III)

wherein t and u are 1, 2, or 3; and

L is a linking group.

13. The method of claim 12 wherein the bleaching agent is a ferric complex of a tridentate aminopolycarboxylic acid having Formula II wherein R is an H or an alkyl group of 1 to 3 carbon atoms, and r and s are 1.

14. The method of claim 12 wherein the bleaching agent is a ferric complex of a tetradentate aminopolycarboxylic acid having Formula III wherein L is an alkylene group of 1 to 3 carbon atoms, and t and u are 1 or 2.

15. The method of claim 13 wherein the tridentate aminopolycarboxylic acid is methyliminodiacetic acid.

16. The method of claim 12 wherein the photographic element is processed in a processing solution containing the chelating compound immediately after bleaching.

17. The method of claim 12 wherein the processing solution containing the chelating compound is a fixing solution.

18. The method of claim 17 wherein the fixing solution contains substantially no ammonium ion.

* * * * *

UNITED STATES PATENT AND TRADEMARK OFFICE

CERTIFICATE OF CORRECTION

PATENT NO. : 5,508,150
DATED : April 16, 1996
INVENTOR(S) : Mary E. Craver, et. al.

It is certified that error appears in the above-indentified patent and that said Letters Patent is hereby corrected as shown below:

Title page....ABSTRACT replace $[HOOC(CH_2)_m(X)((CH_2)_nCOOH)_2]$ with --$MOOC(CH_2)_m(X)((CH_2)_nCOOM)_2$--

Signed and Sealed this

Second Day of July, 1996

Bruce Lehman

*Attest:*

BRUCE LEHMAN

*Attesting Officer*

*Commissioner of Patents and Trademarks*